United States Patent [19]

Klauss et al.

[11] Patent Number: 4,673,538

[45] Date of Patent: Jun. 16, 1987

[54] COOLING TOWER PANEL FROM FIBER CONCRETE OR SIMILAR MATERIAL

[75] Inventors: Heinrich Klauss, Bremen; Kurt Baarsch, Achim, both of Fed. Rep. of Germany

[73] Assignee: Toschi Produktions-Gesellschaft mbH, Rethem, Fed. Rep. of Germany

[21] Appl. No.: 817,736

[22] PCT Filed: May 3, 1985

[86] PCT No.: PCT/EP85/00195

§ 371 Date: Dec. 30, 1985

§ 102(e) Date: Dec. 30, 1985

[87] PCT Pub. No.: WO85/05171

PCT Pub. Date: Nov. 21, 1985

[30] Foreign Application Priority Data

May 4, 1984 [DE] Fed. Rep. of Germany ... 8413605[U]

[51] Int. Cl.[4] ..... B01F 3/04

[52] U.S. Cl. ..... 261/112

[58] Field of Search ..... 261/112, 99

[56] References Cited

U.S. PATENT DOCUMENTS

| | | | |
|---|---|---|---|
| 3,211,219 | 10/1965 | Rosenblad | 261/112 |
| 3,403,724 | 10/1968 | Gutkowski | 261/112 |
| 3,475,012 | 10/1969 | Britton et al. | 261/112 |
| 4,374,542 | 2/1983 | Bradley | 261/112 |

FOREIGN PATENT DOCUMENTS

| | | | |
|---|---|---|---|
| 2502303 | 8/1975 | Fed. Rep. of Germany | 261/112 |
| 8302704 | 5/1983 | Fed. Rep. of Germany | 261/112 |
| 3222892 | 12/1983 | Fed. Rep. of Germany | 261/112 |
| 3239510 | 4/1984 | Fed. Rep. of Germany | 261/112 |
| 28970 | of 1909 | United Kingdom | 261/112 |
| 990851 | 5/1965 | United Kingdom | 261/112 |

*Primary Examiner*—Tim Miles

*Attorney, Agent, or Firm*—Wood, Herron & Evans

[57] ABSTRACT

A cooling tower panel made from fiber concrete or similar material has surfaces which incorporate bosses and coordinated depressions extending in lines. The water flowing across the panels has a large wetting surface available, and the water does not flow off the surfaces in laminar fashion either. To impart good heat exchange properties to the panel and to enable a low-cost manufacture, flattened or rounded points or the like protrude linewise from each of the two surfaces and are opposed by equal lines of depressions. Each panel surface features a plurality of both point lines and depression lines extending approximately parallel to each other.

6 Claims, 2 Drawing Figures

COOLING TOWER PANEL FROM FIBER CONCRETE OR SIMILAR MATERIAL

The invention concerns a cooling tower panel made from fiber concrete or similar material whose surfaces are structured by bosses and coordinated depressions which extend linewise.

Cooling panels of this type are extensively used in cooling tower of. e.g., power plants for recooling large amounts of cooling water by ambient air. The cooling tower panels are often suspended in packages within a cooling tower so that their surfaces extend in the vertical plane. The water to be cooled is rained or sprayed on the panels in the area of the top panel edges. It flows then downward across the panel surfaces in counterflow to cooling air directed upward from below. At the bottom it encounters either another cooling tower panel or is collected for recirculation in the cooling process.

The surface structure of such panels is of primary significance. The aim is to offer the water a large wetting surface, and to prevent it from draining across the surfaces in laminar fashion, thereby achieving an optimum cooling effect. Manufacturing aspects must be taken into account in conceiving cooling tower panels, such as shown, e.g., in the German utility patent No. 83 02 704.1. The problem underlying the invention is to provide a structured cooling tower panel which possesses good heat exchange properties yet permits a low-cost manufacture.

A cooling tower panel made from fiber concrete or similar material, and provided with a novel structure, solves the above noted problem. The panel of this invention is characterized in that one panel surface is provided with lines of spaced points or the like with flattened or rounded heads which protrude out of that surface, and the other panel surface is provided with similar lines of depressions, and in that plurality of both lines of points and lines of depressions on the two surfaces extend approximately parallel one to the other. In preferred form, each surface of the cooling tower panel includes corresponding lines of depressions provided on both sides of always two immediately adjacent lines of points, both the points and the depressions of each line pair being offset relative to one another in the line direction, and the points and depressions alternating on each of the surfaces in a direction perpendicular to the line direction. The panel cross section extending perpendicular to the line direction preferably has a slightly wavy design. The advantage of this cooling panel structure, for one, lies in the good cooling effect of the panel and, for another, in its low cost manufacture.

Figure 1:
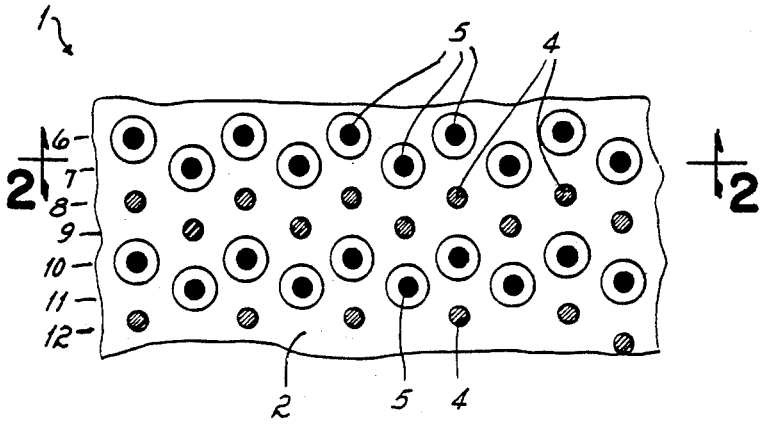
Figure 2:
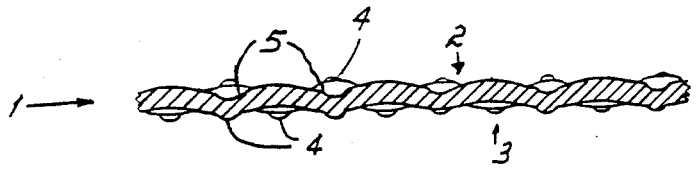

A preferred embodiment of the invention will be more fully explained hereafter with the aid of the figures described below:

FIG. 1 illustrates a schematic plan view of a cooling tower panel in accord with the principles of this invention; and FIG. 2 illustrates a section taken along line II—II of FIG. 1.

A cooling tower panel 1 has a basic thickness of about 5 mm, a surface 2, and an opposite surface 3, all as shown in FIG. 1. The surface 2 is structured by bosses and/or points 4 which extend linewise and depressions extending in lines parallel to the lines of the bosses and/or points. The bosses and/or points 4 have approximately the shape of a small mound which protrudes out of the panel surface 2, and have a flat and/or rounded surface. Each boss and/or point 4 on the one panel surface 2 is opposed by a depression 5 in the other panel surface 3 which protrudes into the area of this point 4. In the embodiment shown, lines of points 4 and depressions 5 are provided in pairs on each of the surfaces 2, 3. From top to bottom, FIG. 1 shows firstly two lines 6, 7 of depressions 5, then two lines 8, 9 of points 4, and then again two lines 10, 11 of depressions 5, and finally a line 12 of points 4. The points 4 of each pair of point lines 8, 9 are offset in line direction, and naturally perpendicular to it. The same applies to the depressions 5 in each of the two adjacent lines 6, 7 and/or 10,11 of depressions 5. A zig-zagging row of points 4 in the area of each point line pair 8, 9 and a corresponding zig-zagging extension of depressions 5, is thereby created! Note each boss and/or point 4 is followed by a depression 5, which is followed again by a point 4, in a direction perpendicular to the line direction.

The cross section of the cooling tower panel 1, as shown in FIG. 2, extends exactly along the line 7 of the section of the surface 2 shown in FIG. 1. The depressions 5 of the line 7 are clearly recognizable in FIG. 2. A boss and/or point 4 on the surface 3 corresponds to each depression 5. The material of the cooling tower panel 1 is crowned between the depressions 5 of line 7. The points 4 on the surface 3 which correspond to the depressions 5 of line 6 on the surface 2 are thereby recognizable. And the shape of the depressions 5 and/or the points 4 also is clearly recognizable.

The panel structure of this invention can be advantageously used in many ways, not only for cooling towers but also generally as a trickle panel.

Having described in detail the preferred embodiment of my invention, what we desire to claim and protect by Letters Patent is:

1. A cooling tower panel comprising one surface having a plurality of lines of spaced points protruding out of the surface, the other of said surfaces having a plurality of similar lines of depression within that surface, each panel surface having a plurality of lines of points and also lines of depressions extending in an approximately parallel alignment one with the other, and each panel surface having two corresponding lines of depressions on both sides of two immediately adjacent lines of points, both the points and the depressions of each line pair being offset relative to one another in the line direction, and the points and depressions alternating in a direction perpendicular to the line direction.

2. A cooling tower panel in accord with claim 1, the panel cross section extending perpendicular to the line direction being of a slightly wavy fashion configuration.

3. A cooling tower panel in accord with claim 1 or 2, said panel being made from fibre concrete.

4. A cooling tower panel comprising an obverse surface having a plurality of lines of spaced points protruding out of said surface, a reverse surface having a plurality of lines of depressions within that surface, said lines of points and lines of depressions extending in approximately parallel alignment one with the other, each panel surface having two corresponding lines of depressions on both sides of two immediately adjacent lines of points, both the points and the depressions of each line pair being offset relative to one another in the line direction, and the points and depressions alternating in a direction perpendicular to the line direction, and said obverse and reverse surfaces defining a thickness therebetween that dimensionally is at least equal to the height of said points above said obverse surface, and is at least equal to the depth of said depressions within said reverse surface.

5. A cooling tower panel as set forth in claim 4, the panel cross section extending perpendicular to the line direction being of a slightly wavy fashion configuration.

6. A cooling tower panel as set forth in claim 4, said panel being made from fiber concrete.

* * * * *